United States Patent [19]

McSherry

[11] 3,995,806

[45] Dec. 7, 1976

[54] STACKABLE CARTON WITH RECLOSABLE POUR SPOUT CONSTRUCTION

[76] Inventor: Thomas McSherry, 404 Terrace Road, Bayport, N.Y. 11705

[22] Filed: July 11, 1975

[21] Appl. No.: 596,026

[52] U.S. Cl. ..... 229/17 R; 229/7 R

[51] Int. Cl.[2] ..... B65D 5/72

[58] Field of Search ..... 226/7 R, 17 G, 17 R

[56] References Cited

UNITED STATES PATENTS

| | | | |
|---|---|---|---|
| 2,850,222 | 9/1958 | Hultin | 229/17 R |
| 3,083,890 | 4/1963 | Ignell | 229/17 R |
| 3,107,839 | 10/1963 | Kauffeld | 229/17 R |
| 3,110,433 | 11/1963 | Mosse et al. | 229/17 R X |
| 3,175,749 | 3/1965 | Elias | 229/17 R |
| 3,306,514 | 2/1967 | MacKendrick | 229/17 R |
| 3,367,553 | 2/1968 | Francis | 229/17 R |
| 3,390,829 | 7/1968 | Malby et al. | 229/17 R X |
| 3,447,732 | 6/1969 | Deckys | 229/17 R |
| 3,524,578 | 8/1970 | Benezra | 229/7 R |
| 3,672,557 | 6/1972 | Krzyzanowski | 229/17 R |

*Primary Examiner*—Davis T. Moorhead
*Attorney, Agent, or Firm*—Nolte and Nolte

[57] ABSTRACT

A stackable carton with a V-shape over center hinged pour spout formed in one wall of the carton is provided. The V-shaped pour spout when pulled in the open position forms a funnel for dispensing the contents of the carton. On closing the pour spout, a three pivot construction, by toggle action, reseals the carton and protects its contents.

7 Claims, 10 Drawing Figures

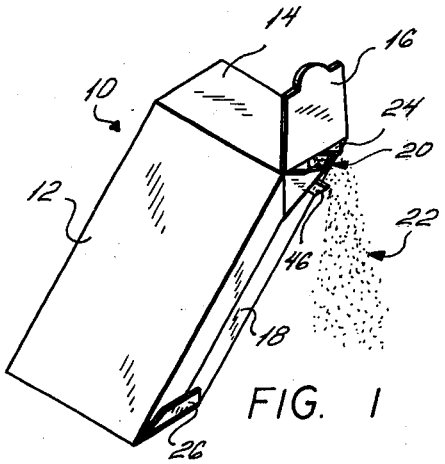
FIG. 1
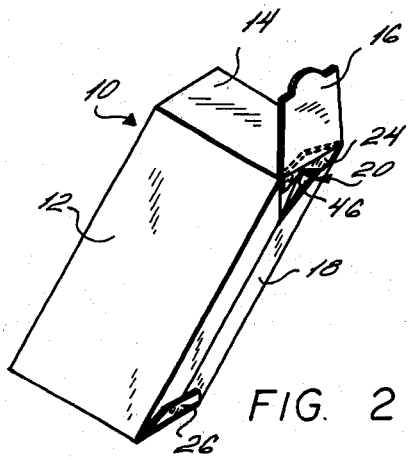
FIG. 2
FIG. 3
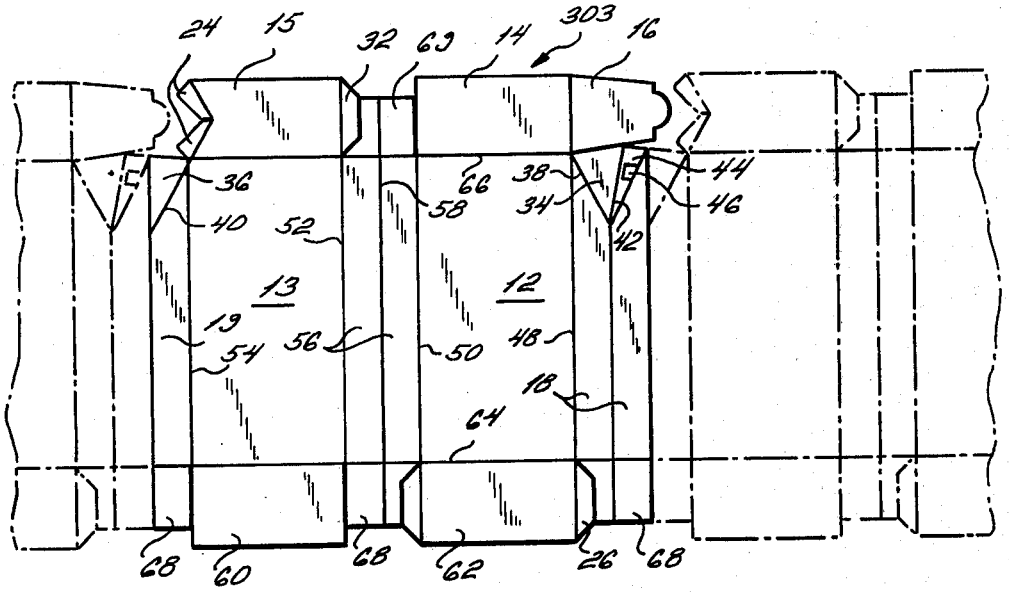
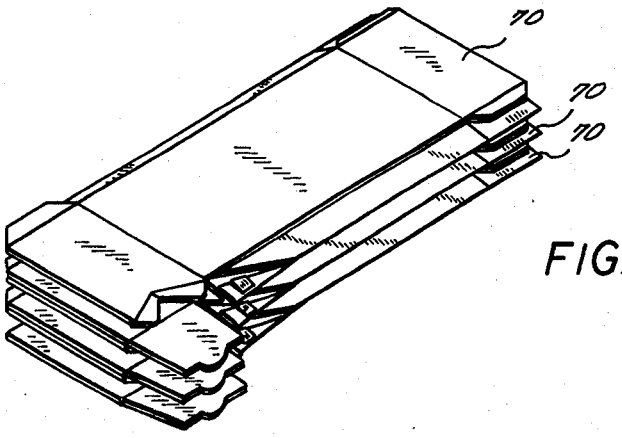
FIG. 4

STACKABLE CARTON WITH RECLOSABLE POUR SPOUT CONSTRUCTION

BACKGROUND OF THE INVENTION

1. Field

Pour spout carton.

2. Prior Art

There are numerous examples of pour spout cartons in the prior art. For example, in U.S. Pat. No. 3,672,557 to Krzyzanowski there is described a carton and a blank therefor where one entire wall is constructed of two panels hinged together on a central or axial fold line to form a V-shaped infolded carton wall having a transverse fold line about which a portion of the wall can be hinged to form a pour spout construction.

The patent to Ryder, U.S. Pat. No. 2,842,302, discloses a pour spout construction in one edge and part of a front and side wall form a pouring spout carton.

The patent to Kuchenbecker, U.S. Pat. No. 3,172,594, illustrates an example of the so-called "gable top" pour spout carton or container.

The patents to Ignell, U.S. Pat. No. 3,083,890; Francis, U.S. Pat. No. 3,367,553; Benezra, U.S. Pat. No. 3,524,578; Brown, U.S. Pat. No. 3,869,078; Reil, U.S. Pat. No. 3,797,726; and Gill, U.S. Pat. No. 3,549,080 are further illustrations of the variety of cartons with pour spouts which have been provided in the prior art and which have not met with full acceptability, nor have they overcome the fundamental problems of forming an effective reclosable pour spout in a container.

SUMMARY OF THE INVENTION

The object of the carton of this invention is to provide a good working pouring spout carton which requires only slight modification of standard filling and shipping equipment. The specific form of pour spout construction provided by this invention permits close to perfect resealing to protect the contents once the sealed package has been opened by a user.

Briefly, the pour spout is formed in one of the walls of the carbon by a three pivot construction with flexible members therebetween. It is desirable to provide a handle on the center of the three pivot points to permit the user to pull the pour spout open to form a funnel for dispensing the contents of the container and to reclose the pour spout by pushing in on the handle and thereby effectively resealing the carton. Additional features are an outside sealing flap and a pair of mechanical sealing flaps which overlie the top edges of the V-shaped pouring spout when it is in its closed position.

The particular construction and the mechanics of the pour spout carton of this invention are fundamentally different from those illustrated in the prior art as referred to above.

DESCRIPTION OF THE DRAWINGS

FIG. 1 illustrates, in perspective, the pour spout carton of this invention in its open position dispensing the contents of the package;

FIG. 2 is an illustration of the opened carton of this invention which has been resealed by inward movement of the V-shaped pouring spout construction;

FIG. 3 shows in solid lines the blank which is formed for the purpose of making the carton of this invention and in phantom lines illustrates the adjacent blanks showing one way in which the carton of this invention could be manufactured by die cutting and crease line formation from a moving web of material;

FIG. 4 shows a plurality of the cartons of this invention stacked as they would be stacked in preparation for shipment to a customer who is then to fill them with the contents;

FIG. 6 is a perspective illustration of the complete cartons of this invention on a conveyor being transported to cartoning equipment for shipment to stores and the like;

DESCRIPTION OF THE PREFERRED EMBODIMENTS

Figure 5A:
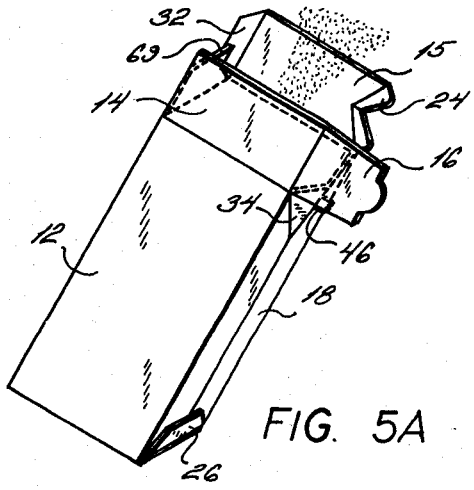
FIG. 5*a* is an illustration in perspective of filling the carton of this invention from the top after the bottom portions have been sealed and prior to sealing the top portion.

The carton of this invention is illustrated generally at 10 and is comprised of wall panel 12, top 14 having a sealing flap 16, wall panels 18 having a pour spout indicated generally at 20, the details of the construction of which will be explained below. As shown in FIG. 1, i.e. at the time the carton is dispensing its contents, indicated generally at 22, the mechanical sealing flaps 24 overlie the outer edges of the pour spout 20. The sift proof sealing bottom flaps 26 are illustrated in FIGS. 1 and 2. The details of that construction will be described below, but are of standard form and need not be described in great detail other than to explain that they are the customary siftproof bottom flaps of cartons known in the art.

FIG. 2 illustrates the carton illustrated in FIG. 1 except that the pour spout 20 is in its closed position as indicated by the dotted lines. It is noted that the mechanical sealing flaps 24 are scored at their joinder to top portion 15 in the known manner to overlie the top of the pour spout 20 and therefore provide a good mechanical seal over the edges of the pour spout.

In order to understand how the carton as illustrated in FIGS. 1 and 2 is formed, reference should be made to FIG. 3. In the solid lines, a completed blank 30 is shown prior to the formation of the blank 30 into a carton such as is illustrated in 10. It will be noted that the die cut wall panels 12 and 13 are provided at their respective top edges with the top sealing panel 14 and its underlying top portion 15 along with a sealing flap 32 for the side of the carton opposite the pour spout 20. It is to be noted that the pour spout 20 will be formed when the blank 30 is glued along its longitudinal edges from the spout elements 34 and 36 which are formed with line hinges 38, 40 as well as a line hinge 42 between gluing flap 44 and spout element 34. Also, it is to be noted that there is a scored cut-out tab 46 formed in gluing flap 44 which will form the handle for the pour spout 20 as will be described below. Scored fold lines 48, 50, 52 and 54 mark the corners that separate the wall panel 18 and gluing flap 19 from wall panels 12, 13. The panel wall 56 has a fold line 58 which performs a very important function in permitting the box blank 30, when sand 18 and flap 19 are glued together along with a corresponding portion of the glue flap 44 to portion 36, to be shipped in a flattened condition.

While not illustrated specifically it is to be noted that the preceding blank and the succeeding blank as illustrated in phantom lines in FIG. 3 have identical fold lines and are cut or scored in exactly the same way.

In order to complete the bottom of the carton 10 there is a seal flap 60, a separate outer seal flap 62 which has the edge sealing flaps 26 formed at the bottom of the front and back portions 12, 13 with a fold line 64 passing completely across the blank 30. Also, there is a top fold line 66 which permits the folding of the members 14, 15 over their associated flaps 69 which forms the portion of the top seal opposite the position of the pour spout 20. At the bottom portion, or course, there are sealing flap portions 68 which complete the sift-proof bottom closure of the carton 10.

After the blank 30 has been formed as illustrated in FIG. 3, the panels 18 and 19 are glued together with the side 18 overlying side 19 and the glue flap 44 being glued to and joined to its opposite portion 36 with the single exception of the area which underlies the scored section 46 which is not glued in order to leave the tab 46 without its being glued down.

Following the gluing operation between panels 18, 19 and the pour spout elements 34, 36, 44, the carton blanks 30 are formed into flattened members which are ready for filling and sealing in standard machinery. At this point it will be noted that, despite the fact that when glued together the dimensions of the pour spout 20 is such that it will either remain in the open or closed position and the top dimension is greater than the width of the panels 18, 19, since there is the fold line 58 in the opposite panel this permits the boxes to be shipped in a flattened condition and take up the minimum amount of space for shipment to be filled and sealed.

In FIG. 4 the fully prepared cartons 70 are shown in their stacked condition for shipment.

Figure 5B:
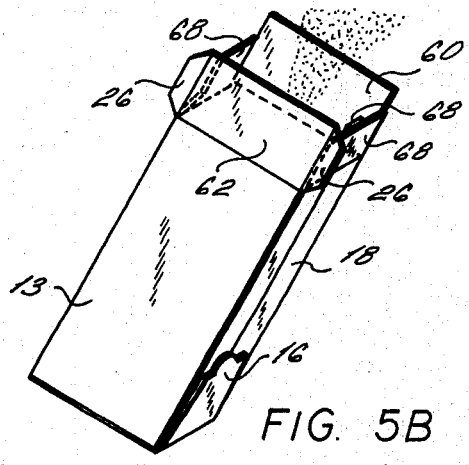
FIG. 5*b* is a figure similar to 5*a*, except that it shows the top portions of the carton of this invention having been sealed and the carton is being filled from the bottom.

FIGS. 5*a* and 5*b* illustrate the two ways of completing one end of the carton 10 for filling. Specifically in FIG. 5*a* it shows that the bottom elements 60, 62, 68 and the seal flaps 26 have been sealed in position and the carton of this invention is illustrated as being filled from the top.

Similarly, in FIG. 5*b* the top elements 14, 15, 16 and the associated flaps 69 are shown as having been sealed and the bottom elements 60, 62, 68 and 26 are still open and the carton 10 is being filled from the bottom.

Figure 6:
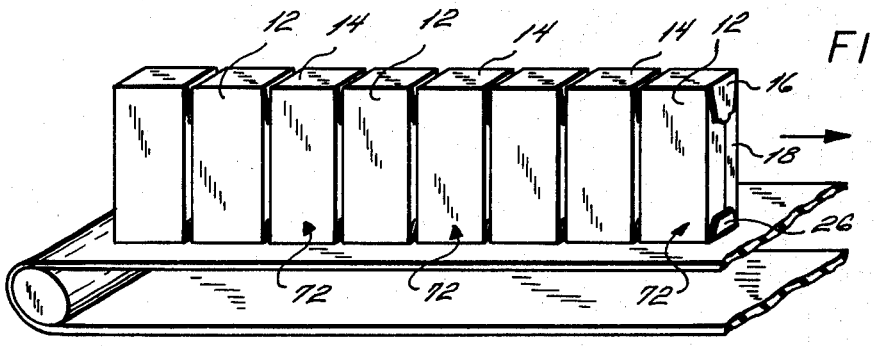

FIG. 6 is an illustration in perspective showing that completed cartons have been filled and have been sealed and are being passed to cartoning equipment for shipment to the stores and the like. It should be noted at this point that cartons 72 are completely stackable and have none of the disadvantages of storing or occupying excess space as is characteristic with the typical "gable top" type containers as illustrated in the prior art referred to above.

Figure 7A:
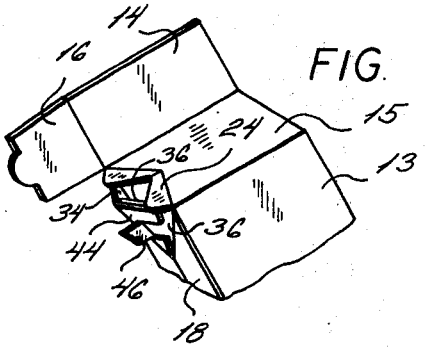
FIG. 7*a* is a perspective view, broken away, of the carton of this invention illustrating the details of construction when the pour spout is in its open position.

Turning now to FIG. 7*a*, it will be noted that the sealing flap 16 and its associated top portion 14 have been pulled out of sealing relationship with the element 15 for the purpose of more fully illustrating the pour spout construction 20 and its associated mechanical seal elements 24.

In FIG. 7*a* the pour spout 20 is shown in the open position showing that the pour spout 20 is formed from flap 36 with its associated line hinge 40, from the flap 34 with its associated line hinge 42 and glue flap element 44 which overlies and is glued to flap 36 adjacent line hinge 42. The pull handle 46 has been pulled out into the open position and is the way in which the elements 34, 36 are pushed into closed position or pulled into open position.

Figure 7B:
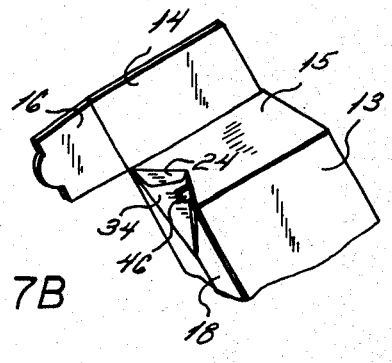
FIG. 7*b* is a view similar to FIG. 7*a*, except that it illustrates the carton of this invention with the pour spout in the closed position.

In FIG. 7*b* the same general arrangement of parts is illustrated as in 7*a* except in this instance the mechanical seal flaps 24 which overlie the corners of the opening formed by opening pour spout 20 are now folded down over the tops of the elements 34, 36 in the known manner to mechanically seal the top 15 with the top portions of elements 34, 36. Again, the associated elements 16 and 14 are shown out of their normal position for better illustration of the pour spout construction 20.

Figure 8:
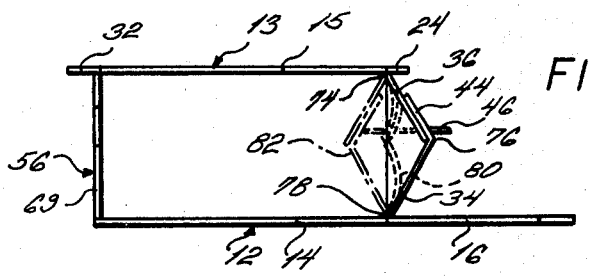
FIG. 8 is a detailed view of the mechanics of the pour spout construction of this invention illustrating in solid lines the pour spout in its open position and in dotted lines partially closed position and fully closed positions.

FIG. 8 shows in solid lines the position of the respective portions of the pour spout and the front and back walls of the carton 10 without the sealing flap 16 or its associated top cover element 14 in position. Since elements 34 and 36 and glue flap 44 take up more than is provided in the triangular area formed by line hinges 38 and 40, and since the elements are relatively flexible even in the area of their overlap of the glue flap 42, they, as shown in the intermediate position in dotted lines illustrated generally at 80, tend to flex, thus permitting the construction to be pushed toward their closed position shown at 82, again in dotted lines. This over-center toggle type of action permits a positive resealing and opening of the general pour spout construction 20 and is uniquely different from anything disclosed in the prior art.

While the pour spout 20 has been illustrated generally at the top of one side wall of the carton 10, it will be appreciated that the position of the elements constituting the V-shaped pour spout could be almost any place along the side or front wall of the carton or could be at the bottom of the side wall rather than at the top. The basic elements of the construction of the pour spout being the three pivot point, flexible portions of the generally V-shaped pour spout and the overcenter toggle action thereby permitted.

While the invention has been described generally in connection with a specific preferred embodiment, it will be appreciated by those skilled in the art that there are other modifications which could made which fall within the scope of the appended claims.

What is claimed is:

1. A stackable pour spout container comprising flat top and bottom portions and wall means extending therebetween for retaining pourable contents therewithin, a pour spout integral with said wall means and occupying a triangluar area, the base of which area is adjacent said top portion, the sides of which area are equal and extend to the apex of the area, which apex is spaced a distance from said bottom portion, said pour spout consisting of a pair of flexible triangular pour spout elements having apices substantially in common with the apex of the triangular area, said elements being joined along a central line hinge lying in a plane bisecting the triangular area through the apex thereof and having sides joined to said wall means along line hinges which are co-extensive with and extend along planes common with the sides of the triangular area, the base edges of said triangular elements being free and of a cumulative length longer than the base of said triangular area, said spout being movable between a closed position in which the base edges of said flexible triangular pour spout elements converge inwardly of said wall means and an open position in which the base edges of said flexible triangular pour spout elements converge outwardly of said wall means, and means integral with said flexible pour spout elements for pulling the same from the closed to the open position.

2. The stackable container of claim 1 in which said flat top portion is formed with an outwardly diverging V-shaped open area above the free base edges of said flexible triangular pour spout elements and mechanical seal flap means extend from fold lines along the edges of the opening for overlying the free based edges of said spout elements when in the open position and for overlying outer surfaces of the upper portion of said spout elements when in the closed position, said mechanical seal flap means being formed adjacent the plane of movement of said central hinge line with outwardly diverging free edges and constituting with said free edges of said spout elements when in the open position an opening for dispensing the contents of said container, said mechanical seal flap means further constituting with said spout elements when overlying the same in the closed position, a seal therebetween.

3. The stackable container of claim 1 in which said triangular pour spout elements are separately formed, and are joined along said central hinge via a securing flap formed integral with one of said elements, said central line hinge being formed between said securing flap and said one of said elements, said securing flap overlying the other of said elements and secured thereto, said pulling means comprising a tab formed in said securing flap.

4. The stackable container of claim 1 in which said top portion extends from said wall means along a fold line therebetween which fold line defines an upper edge of said container and there is provided a member extending from an opposite upper edge of said container, overlying said top portion and secured thereto, said overlying member being formed with outer flap means extending from a fold line extending along the base of the triangular area for overlying said spout elements in secured engagement with said wall means for sealing the spout elements therebehind.

5. A blank for a stackable pour spout container comprising first, second, third and fourth wall panels each having tops and bottoms and each being of predetermined width, and respectively joined along straight scored fold lines and a gluing flap of less than the predetermined width of said first wall panel joined along a straight scored fold line with said fourth panel, said first wall panel and said gluing flap providing adjacent their respective tops flexible triangular pour spout elements, the base edges of which define the upper edges of said first wall panel and said gluing flap, the apices of which lie in a plane normal to said straight scored fold lines and are spaced from the bottoms of said first wall panel and said gluing flap, the cumulative lengths of said base edges being longer than the predetermined width of said first wall panel.

6. The blank of claim 5 in which the base edges of said spout elements diverge upwardly.

7. The blank of claim 5 wherein said first and third wall panels are scored along fold lines centrally of the widths thereof and parallel to said straight scored fold lines between said panels, and comprising means for temporarily folding said first and third panels when said first panel and said gluing flap are joined and said straight scored fold lines are bent forming said blank into an openended right cylinder.

* * * * *